US006482886B1

(12) United States Patent
Finlayson et al.

(10) Patent No.: US 6,482,886 B1
(45) Date of Patent: Nov. 19, 2002

(54) METHOD FOR EXTERNALLY SIZING FIBROUS MATERIALS

(75) Inventors: Malcolm F. Finlayson, Houston, TX (US); Kenneth E. Springs, Clute, TX (US); John J. Gathers, Pearland, TX (US); James L. Cooper, Lake Jackson, TX (US); Walter L. Vaughn, Conroe, TX (US); Brian H. Schumann, Clute, TX (US); Stephen M. Oliver, Wollerau (CH)

(73) Assignee: The Dow Chemical Company, Midland, MI (US)

( * ) Notice: Subject to any disclaimer, the term of this patent is extended or adjusted under 35 U.S.C. 154(b) by 0 days.

(21) Appl. No.: 09/077,793

(22) PCT Filed: Dec. 5, 1996

(86) PCT No.: PCT/US96/19280

§ 371 (c)(1),
(2), (4) Date: Sep. 3, 1998

(87) PCT Pub. No.: WO97/22754

PCT Pub. Date: Jun. 26, 1997

Related U.S. Application Data

(60) Provisional application No. 60/008,209, filed on Dec. 5, 1995.

(51) Int. Cl.[7] ..... C08L 3/02; C08L 23/08; C08L 33/02; B05D 3/00

(52) U.S. Cl. ..... 524/562; 524/734; 427/326

(58) Field of Search ..... 524/562, 734, 524/548; 427/326; 428/543; 527/313, 314

(56) References Cited

U.S. PATENT DOCUMENTS

| | | | | |
|---|---|---|---|---|
| 3,674,896 A | * | 7/1972 | Purcell et al. | 525/57 |
| 3,872,039 A | | 3/1975 | Vaughn et al. | 260/17.4 |
| 3,919,149 A | | 11/1975 | Cushman et al. | 260/28.5 |
| 3,925,328 A | * | 12/1975 | Shibahara et al. | 524/52 |
| 3,983,268 A | * | 9/1976 | Scharf et al. | 427/341 |
| 4,070,319 A | | 1/1978 | Carel et al. | 260/29.4 |
| 4,301,017 A | * | 11/1981 | Kightlinger et al. | 252/8.83 |
| 4,376,177 A | * | 3/1983 | Matsunaga et al. | 524/35 |
| 4,508,804 A | * | 4/1985 | Asao et al. | 430/62 |
| 4,835,212 A | * | 5/1989 | Degen et al. | 524/734 |
| 5,387,635 A | | 2/1995 | Rowland et al. | 524/379 |
| 5,460,645 A | * | 10/1995 | Pandian et al. | 524/43 |
| 5,550,177 A | * | 8/1996 | Fanta et al. | 524/47 |
| 6,034,181 A | * | 3/2000 | Bazaj et al. | 525/218 |

FOREIGN PATENT DOCUMENTS

| | | |
|---|---|---|
| EP | 0-171-670 | 2/1986 |

OTHER PUBLICATIONS

English Translation of JP4204746 (1992).*

International Search Rpeort; Dated Jun. 4, 1997 Issued by the EPO Acting as the International Searching Authority in PCT/US96/19280.

Derwent Abstract No. 92–296371 [36]; Japanese Publication; Patent No. JP4204746, Dated Jul. 27, 1992.

* cited by examiner

*Primary Examiner*—Vasu Jagannathan
*Assistant Examiner*—Callie E. Shosho

(57) ABSTRACT

Fibrous product is externally sized by applying to the material a basic aqueous dispersion of an interpolymer of an ethylenically unsaturated monomer and an ethylenically unsaturated carboxylic acid comonomer. The preferred dispersions which have lower initial viscosities provide dispersion/starch dilute solutions with higher viscosities and improved external sizing effectiveness. Resulting fibrous products are adequately sized and exhibit excellent printability and strength properties.

17 Claims, No Drawings

METHOD FOR EXTERNALLY SIZING FIBROUS MATERIALS

This application claims the benefit of provisional application No. 60/008,209, filed Dec. 5, 1995.

The present invention relates to the external sizing of fibrous materials, particularly cellulosics such as paper. The external sizing agent is an interpolymer of an ethylenically unsaturated monomer and an ethylenically unsaturated carboxylic acid comonomer.

Sizing is the process of providing fibrous materials such as cellulosics (e.g., paper) and textiles (e.g., fabrics) with resistance to penetration by liquids. Sizing may be accomplished via an internal sizing process, an external sizing process, or as is usually the case, a combination of both.

The processes of internal sizing and external sizing are very different from each other in many respects. Many materials that are known to be effective as internal sizing are generally not effective as external sizing agent and vice versa. Internal sizing is a method by which the sizing is initiated before the fibrous material is formed. This is usually accomplished by adding an internal sizing agent, in conjunction with a retention aid, directly to a fiber slurry to precipitate the sizing agent upon the fibers. Internal sizing agents are generally hydrophobic in nature, i.e., the sizing agents will have their nonpolar portions oriented about the surface of the fibers forming a protective layer wherein the penetration of liquids is retarded once the fibers are fabricated into a finished fibrous product such as paper and a fabric. See Biermann, C. J., Essentials of Pulping and Papermaking, Academic Press, Inc., 1993, p. 197.

External sizing, which is also referred to as surface, tub, or calender sizing, is substantially different from internal sizing in that external sizing agents are applied to one or both surfaces of already-formed fibrous products in the absence of retention aids. Because external sizing is accomplished by a different mechanism than internal sizing, certain hydrophobic materials as well as non-hydrophobic materials, such as starch, can be effectively used as external sizing agents. Whereas internal sizing takes place on a substantial portion of the fibers throughout the three dimensional matrix of the paper or fabric and generally involves modification of the surface energy of the fibers, external sizing occurs when an external sizing agent is applied to a surface of a fabricated fibrous product and either fills the capillaries and voids between individual fibers, or acts to modify the surface energy of the fibers nearest the surface rather than all the fibers throughout the matrix, rendering liquid penetration more difficult. See Biermann, p. 197. Because of the requirement of filling surface capillaries, the surface tension or energy of the external sizing agent is an important factor in successful external sizing of fibrous products.

Interpolymers of an ethylenically unsaturated monomer and an ethylenically unsaturated carboxylic acid comonomers have been used for internal sizing of paper previously. See, for example, U.S. Pat. Nos. 3,872,039; 3,899,389; and 4,181,566. However, heretofore, such interpolymers have not been employed as external sizing agents. That is, these disclosures by Vaughn et al. teach the use of such interpolymers as internal sizing agents.

For internal sizing of paper, Vaughn et al. in U.S. Pat. Nos. 3,872,039; 3,899,389; and 4,181,566, described the combination of an ammoniated copolymer of ethylene and an ethylenically unsaturated carboxylic acid comonomer and a cationic retention aid. The advantage of the internal sizing systems disclosed by Vaughn et al. is said to be their utility over the complete range of pH conditions found in paper-making operations. For these systems, Vaughn et al. taught the order of addition of the sizing agent and the retention aid to a conventional paper making process was non-critical, however, Vaughn et al. preferred to introduce their sizing agent prior to the addition of a retention aid.

Rowland et al. in U.S. Pat. Nos. 5,206,279 and 5,387,635 disclosed aqueous dispersions of interpolymers of ethylene and an ethylenically unsaturated carboxylic acid comonomer. Rowland et al. described the combination of two bases, one as a weak cation and the other as a strong cation. Rowland et al. teach that this combination permits the preparation of stable dispersions of interpolymers having relatively low carboxylic acid concentrations (e.g. less than 15 weight percent acrylic acid content). However, Rowland et al. did not disclose that their dispersions were useful as external sizing agents for fibrous materials.

While there are a variety of known sizing systems and alleged solutions, there is still a need for an external sizing system that provides improved sizing performance, i.e., higher Hercules Size Test (HST) values as measured by accordance with TAPPI method T 530 pm-89. Higher HST values translate into improved hydrophobicity and liquid penetration resistance.

To fulfill these objects, we have discovered a novel process for external sizing fibrous materials and products. The process comprises applying a basic aqueous dispersion of an interpolymer of an ethylenically unsaturated monomer and an ethylenically unsaturated carboxylic acid to a fibrous material after the fibrous material has been finished or fabricated into its final form. In one preferred embodiment, the basic aqueous dispersion is prepared at a controlled reduced viscosity to provide dilute solution with a starch having higher viscosities.

The present process is particularly suitable for external sizing of paper and paper products. Further, in addition to providing improved external sizing, the present process provides fibrous products with improved cohesive strength and improved printability. An advantage of the inventive process is now processors and mills can employ the same or similar basic aqueous dispersions for purposes of external sizing and internal sizing, thereby eliminating the need to buy, receive, store and use different substances for internal sizing and external sizing. Another advantage provided by the present process is the use of basic aqueous dispersions which are stable and do not require the use of surface active ingredients.

The term "external sizing," is used herein, to refer to a method of sizing in which a sizing material is contacted with fabricated finished fibrous material under conditions effective to size the fibrous material, i.e., deposit the sizing agent on the fibrous material and increase the hydrophobicity of the fibrous material as measured in seconds by the Hercules Size Test, TAPPI method T 530 pm-89. Accordingly, the term "external sizing" is used herein generically and as such is inclusive of such terms as "surface sizing," "tub sizing," "calender sizing" and the like.

The term "water-dispersible," as used herein, refers to a material which can exist in the form of a stable aqueous colloidal dispersion in the absence of a surface active agent or surfactant.

The term "ethylenically unsaturated monomer," as used herein, refers to any water-immiscible monomer containing a terminal double bond capable of polymerization under normal conditions of free-radical addition polymerization to form a water-insoluble homopolymer having a polyethylenic backbone.

The term "ethylenically unsaturated carboxylic acid comonomer" is used herein to refer to a comonomer containing alpha-beta unsaturation and a carboxylic acid group and which is capable of free-radical addition interpolymerization through the ethylenically unsaturated group with ethylenically unsaturated monomers.

The term "interpolymer", as used herein, refers to polymers prepared by the polymerization or interpolymerization of at least two different types of monomers. The generic term "interpolymer" is inclusive of the term "copolymer" and the term "terpolymer." The term "copolymer" is usually employed to refer to a polymer prepared from two different monomers such as an ethylene-acrylic acid (EAA) copolymer. Conversely, the term "terpolymer" is usually employed to refer to a polymer prepared from three different types of monomers such as an ethylene-acrylic acid-vinyl acetate (EAA/VA) terpolymer.

The term "dilute solution" is used herein to refer to external sizing solutions wherein a dispersion is prepared at a higher solids concentration and then is diluted to some substantially lower solids concentration by the addition of water. Dilute solutions used in the present inventive process are admixtures of at least one basic aqueous dispersion and at least one starch. Generally, the dilute solution will have a total dispersion/starch solids concentration of less than about 20 weight percent.

The amount of size imparted to the fibrous material may be controlled by the amount of basic aqueous dispersion applied. Generally, the amount of basic aqueous dispersion applied will be in the range of 0.1 to 50 pounds per ton of fibrous material, preferably in the range of 1 to 25 pounds per ton of fibrous material.

The amount of sizing required or the desired HST value will depend on specific end-use application requirements. For example, fine printing and writing grade paper typically requires an HST value of about 50 seconds, whereas water repellent outwear apparel can require substantially higher HST values. That is, the higher the HST value, the better the hydrophobicity and water resistance. Thus, where improved hydrophobicity is the primary performance requirement, the present process provides a HST value greater than 45, preferably greater than about 100, more preferably greater than about 200 and most preferably greater than about 500.

Also, in the present process, the basic aqueous dispersions and dilute solutions provide improved hydrophobicity at fairly moderate loadings, i.e., excessive sizing quantities are not required for higher HST value relative to conventional external sizing agents such as styrene maleic anhydride (SMA) systems.

The external sizing agents suitably employed in the practice of this invention are interpolymers of an ethylenically unsaturated monomer and at least one ethylenically unsaturated carboxylic acid comonomer. These interpolymers are generally solid or semi-solid, often in the form of pellets, and water-dispersible.

The surface sizing agent is a normally solid, water-insoluble and alkali-insoluble thermoplastic addition polymer in the form of an aqueous colloidal dispersion. The ethylenically unsaturated carboxylic acid comonomer groups of the interpolymer should be neutralized with ammonia, alkali metal hydroxides, alkaline earth metal hydroxides, or mixtures thereof to form active salt groups. This is normally accomplished by dispersing the interpolymer in aqueous solutions of the above bases or mixtures thereof to form a basic aqueous dispersion of the interpolymer. However, it is understood that an ethylenically unsaturated carboxylic acid in active salt form may be interpolymerized with the ethylenically unsaturated monomer in order to prepare a suitable interpolymer having active salt groups. In any event, the occurrence of active salt groups formed on the interpolymer should be generally throughout the macromolecules thereof so that each macromolecule contains a minimum number of active salt groups sufficient to render the polymer water-dispersible as hereinbefore. The maximum number of acid groups which have been converted into active salt groups that may be present in the macromolecules is fixed by the requirement that the molecule be substantially water-insoluble. Generally speaking, such interpolymers contain from about 1 to about 99 weight percent of acid comonomer, with preferred interpolymers containing from about 6 to about 40 weight percent of acid comonomer and especially preferred interpolymers containing from about 10 to about 25 weight percent comonomer.

Exemplary preferred interpolymers are the random polymer products of copolymerization of mixtures of one or more polymerizable ethylenically unsaturated carboxylic acids having 3 to 8 carbon atoms, inclusive of anhydrides and alkyl esters and half esters, such as acrylic acid, methacrylic acid, maleic acid and anhydride, itaconic acid, fumaric acid, crotonic acid and citraconic acid and anhydride, methyl hydrogen maleate, ethyl hydrogen maleate, and one or more ethylenically unsaturated hydrocarbon monomers such as the aliphatic a-olefin monomers, e.g., ethylene, propylene, butene-1 and isobutene; conjugated dienes, e.g., butadiene and isoprene; and monovinylidene aromatic carbocyclic monomers, e.g., styrene, a-methylstyrene, toluene, and t-butylstyrene.

In addition, other ethylenically unsaturated monomers which are not entirely hydrocarbon can be interpolymerized with the aforementioned carboxylic acid comonomers. Examples of suitable monomers which are not entirely hydrocarbon include, but are not limited to, esters of ethylenically unsaturated carboxylic acids such as ethyl acrylate, methyl methacrylate, ethyl methacrylate, methyl acrylate, isobutyl acrylate, and methyl fumarate; unsaturated esters of non-polymerizable carboxylic acids such as vinyl acetate, vinyl propionate, and vinyl benzoate; vinyl halides such as vinyl and vinylidene chloride; vinyl ethers; ethylenically unsaturated amides and nitriles such as acrylamide, acrylonitrile, methacrylonitrile and fumaronitrile. It is understood that the aforementioned suitable monomers may be interpolymerized with the preferred hydrocarbon monomer and carboxylic acid comonomer in proportions such that a water and alkali-insoluble interpolymer is provided. Preferred interpolymers include interpolymers from about 70 to about 90 weight percent of ethylene, from about 10 to about 20 weight percent of one or more ethylenically unsaturated carboxylic acids, such as acrylic acid and methacrylic acid (unneutralized or neutralized to an active salt form) and from 0 to about 20 weight percent of another ethylenically unsaturated monomer as described hereinbefore such as acrylonitrile, ethyl acrylate and vinyl acetate. The above interpolymers may be made according to the methods and procedures of U.S. Pat. Nos. 3,436,363; 3,520,861; 4,599,392; and 4,988,781.

Other suitable interpolymers can be made from preformed, non-acid polymers by subsequent chemical reactions carried out thereon. For example, the carboxylic acid group may be supplied by grafting a monomer such as acrylic acid or maleic acid onto a polymer substrate such as polyethylene. Additionally, interpolymers containing carboxylic anhydride, ester, amide, acylhalide and nitrile groups can be hydrolyzed to carboxylic acid groups which can then be neutralized to form the activated salt form of carboxylic acid.

In general, better external sizing is provided by dispersions made from interpolymers containing lower carboxylic acid comonomer concentrations. That is, for example, an ethylene acrylic acid (EAA) dispersion containing 15 weight percent acrylic acid will generally provide higher HST values than an ethylene acrylic acid (EAA) dispersion containing 20 weight percent acrylic acid prepared using the same method and procedures at the same percent solids level and diluted and added to the fibrous material at the same concentration. Aqueous dispersions of the above interpolymers employed in the invention may utilize amines (e.g., ammonia and monoethanolamine), alkali metal hydroxides, alkaline earth metal hydroxides or mixtures thereof. Dispersions of the interpolymer in aqueous ammonia to neutralize the carboxylic acid groups can be made according to U.S. Pat. Nos. 3,389,109; 3,872,039; 3,899,389; and 4,181,566. Dispersions of alkali metal hydroxides, alkaline earth metal hydroxides and mixtures with amine (i.e., mixed base dispersion) may suitably be made according to the methods and procedures of U.S. Pat. Nos. 5,206,279 and 5,387,635.

With respect to the cation used to prepare the dispersions useful in the present invention, a mixed base system of potassium or sodium with ammonia provides higher HST values than potassium dispersions. Also, potassium dispersions generally provide higher HST values than ammonia dispersions. Further, potassium dispersions provide better print quality than mixed base or ammonia dispersions while ammonium dispersions provide better toner adhesion. However, mixed base dispersions are preferred, especially at lower interpolymer comonomer concentrations (e.g., $\leqq 15$ weight percent).

Also effective external sizing results are obtained with paper for both virgin fiber sources as well as for 100% recycled fibers. Moreover, external sizing effectiveness is independent of the application method of the dispersion sizing agent. For example, effective sizing is obtained for both continuous and batch sizing operations.

The basic aqueous interpolymer dispersion should contain an amount of solid interpolymer such that fibrous material sizes after application of the dispersion. This amount varies depending upon the particular interpolymer employed and, as discussed above, the particular end-use application. However, unlike typical internal sizing processes, in the present process, all of the interpolymer that is applied or introduced to the fibrous material will be retained on the surface and/or in the capillaries and voids of the fibrous product.

For use in the present invention, the dispersion solids concentration may be as high as 50 percent interpolymer by weight and as low as 1 percent interpolymer by weight. However, the dispersion or dilute solution solids concentration should not be so high that the dispersion or dilute solution is too viscous to be effectively or sufficiently applied.

The degree of sizing obtained is controlled by the amount of solid interpolymer in the dispersion that is applied to the fibrous material. That is, the greater the amount of solid interpolymer applied, the greater the degree of sizing. Correspondingly, the lesser the amount of solid interpolymer applied, the lesser the degree of sizing. Therefore, although other means may be employed to control the degree of sizing, the most convenient means is to adjust the concentration of interpolymer in the dispersion and/or the total amount of dispersion that is actually applied to the fibrous material.

Surprisingly, however, the solids concentration at which the dispersion is initially prepared affects the sizing ability of the dilute solution even though the total final solids concentration of the dilute solution is the same. That is, we have discovered that dispersions prepared at higher percent solids concentrations and used in dilute solutions result in lower HST values all else being the same. Specifically, we have found for the same cation and the same interpolymer comonomer concentration, a 20 percent solids dispersion provides a HST value at least about 50 percent higher than a 35 percent solids dispersion. This discovery is surprising and unexpected in that one skilled in the art would not expect the initial dispersion solids concentration to affect the sizing performance with the applied solids concentration is unchanged.

As such, preferred basic aqueous dispersions for use in the invention have an interpolymer solids concentration less than 35 weight percent, more preferably equal to or less than 25 weight percent, and most preferably equal to or less than 20 weight percent.

As an additional surprise, we have discovered that dilute solutions with higher viscosities result from dispersions initially prepared at lower viscosities and that higher HST values are achieved with dilute solutions having higher viscosities. This was found to be independent of whether deionized or ordinary tap water was employed to cook the starch before use in the dilute solutions. As such, in addition to (or as an alternative to) employing a dispersion prepared at a lower percent solids concentration (e.g., less than 35 percent) to accomplish improved external sizing, the basic aqueous dispersion itself can be prepared at a lower viscosity to effectuate improved hydrophobicity and liquid penetration resistance.

Any known method or technique can be employed to provide a basic aqueous dispersion with a lower initial viscosity including, for example, but not limited to, known methods and procedures that alter the interpolymer used to prepare the dispersion. As another viable technique for use in the present invention, the utilization of higher shear agitation during digestion and agitation during the preparation of dispersion is known to provide reduced dispersion viscosity.

Thus, in specific embodiments of the present invention, the basic aqueous dispersions will have a relatively low initial viscosity at 23° C., preferably less than about 700 centipoises, more preferably less than about 500 centipoises and most preferably less than about 300 centipoises as measured at 23° C. using a Brookfield Viscometer, Model RVTD, equipped with a #3 spindle at 20 rpms.

The dilute solutions used in the present process will contain 1 to 30 weight percent basic aqueous dispersion, preferably 5 to 20 weight percent basic aqueous dispersion and have a concentration in the range of 1 to 20 percent total solids by weight, preferably 2 to 15 percent total solids by weight. The dispersion/starch dilute solutions will have generally have a viscosity greater than about 50, however, in preferred embodiments of the present process, the dilute solution will have a relatively high viscosity at 23° C., preferably greater than 150 centipoises, more preferably greater than 175 centipoises, and more preferably greater than 200 centipoises as measured at 23° C. using a Brookfield Viscometer, Model RVTD, equipped with a #3 spindle at 20 rpm.

Before the basic aqueous dispersion or dilute solution is applied to the fibrous product, it is preferable that the product be substantially dry. By substantially dry is meant that the fibrous product has less than about 10 percent, preferably less than about 6 percent water. Conventional dryers known in the art, e.g. steam can, electrical can, or infrared dryers, may be employed to enhance the drying of the paper.

The basic aqueous dispersion or dilute solution may be applied to the fibrous product by any method sufficient to apply the interpolymer onto the product. For example, the fibrous product may be immersed or soaked in the dispersion or dilute solution for a time sufficient to apply the interpolymer onto the product. The dispersion or dilute solution may also be sprayed onto or rolled onto the fibrous product. Conventional equipment well known in the art may be employed to apply the dispersion or dilute solution. Such equipment as roll coaters, air knives, and blade coaters may be employed. One suitable type of equipment is a size press having a bottom roller which rotates in a pan filled with the dispersion or dilute solution and picks up the dispersion or dilute solution. The dispersion or dilute solution is applied to the fibrous product as the product rolls over the roller.

Additives may be applied to the fibrous material to modify the final properties of the fibrous product, e.g., increase the strength, so long as the additives do not nullify the sizing effect discovered by the applicants. Such additives may include starches, defoamers, dyes, anti-stats, brightners, fillers, etc. Suitable additives may be either added directly to the dispersion or dilute solution or, alternatively, applied to the fibrous material before, during or after the application of dispersion or dilute solution.

In a preferred embodiment of the invention, starch is added with the external sizing agent. Preferred starches are ethylated and cationic starches. Examples of preferred starches include, but are not limited to, an ethylated corn starch (supplied by A. E. Staley Manufacturing Co. under the designation of Ethlex 2025 and supplied by Penford Products Co. under the designation of PG 280), a cationic corn starch supplied by National Starch and Chemical Co. under the designation of CatoSize 270 and quaternary ammonium cationic starch derivatives such as, for example, Stalock 400 available from A. E. Staley Manufacturing Company and Solvatose N available from Avebe Ltd. (Sweden). Other cationic starches useful in the present invention include primary, secondary and tertiary amine cationic starch derivatives and other cationic nitrogen substituted starch derivatives as well as cationic sulfonium and phosphonium starch derivatives. A person with ordinary skill in the art will appreciate that starches and starch derivatives should be employed as gelatins; as such, precooking (e.g., 1 hour at 90–95° C.) may be required prior use although some starches are commercially available already gelatinized.

After the dispersion has been applied to the fibrous material, the fibrous material is allowed to dry at ambient. Alternatively, the sized fibrous material may be dried in a dryer. Typically, the fibrous material is dried to less than about 6 percent moisture content before use.

EXAMPLE 1

A one gallon Parr reactor was configured to allow dispersions to be prepared at temperatures greater than 100° C. and increased pressures. An amount to provide a 35 percent solids dispersion of ethylene-acrylic acid copolymer, EAA, (PRIMACOR™ 5990 available from The Dow Chemical Company, having a 20 weight percent acrylic acid content and a melt index of 1300 grams/10 minutes as measured by ASTM D-1238 Condition 190° C./2.16 kg) was added to a 0.42 mole ratio aqueous ammonium hydroxide (NH4OH) solution in the reactor under agitation. Agitation was provided by a magnetically coupled stirrer having two six-blade impellers (with the blades at a 45° pitched) set at 300 revolutions per minute. A Watlow™ temperature controller ramped the temperature of the reactor from ambient to 120° C. for two hours, then cooled the reactor to ambient temperature. To confirm that the reactor integrity remained intact during the run, the system was pressured with 20 pounds per square inch gauge (psig) of nitrogen at the beginning of the run. After the run was completed, the reactor pressure was checked to confirm that it had returned to the original setting. The resulting 35 percent solids EAA dispersion was then diluted to 6 percent solids for use in external sizing.

The above 6 percent solids dispersion of EAA was applied with a size press at an amount of 15 pounds of solids EAA per ton of paper to paper having an initial Hercules Size Test value of 33 seconds at 85 percent reflectance according to TAPPI method T 530 pm-89. The final Hercules Size Test value of the paper according to TAPPI method T 530 pm-89 after application of EAA and drying was 707 seconds at 85 percent reflectance.

EXAMPLE 2

An equivalent dispersion of 6 percent solids EAA as employed in Example 1 was applied with a size press to paper having an initial Hercules Size Test value of 33 seconds at 85 percent reflectance according to TAPPI method T 530 pm-89 except that the amount of solid EAA applied was 4.85 pounds per ton of paper. The final Hercules Size Test value of the paper according to TAPPI method T 530 pm-89 after application of EAA and drying was 507 seconds at 85 percent reflectance.

The paper of Examples 1 and 2 exhibited excellent properties including good strength and printability.

EXAMPLES 3–6

In another evaluation, four different dispersions were prepared based on ammonium and potassium at a 0.42 mole ratio and at 20 and 35 percent solids concentrations. The interpolymer employed for the four dispersions was an experimental ethylene acrylic acid interpolymer containing 20 weight acrylic acid and having a 1300 g/10 minute melt index as measured in accordance with ASTM D-1238 Condition 190° C./2.16 kg., supplied by The Dow Chemical Company under the designation of XU-60751.16. The degree of sizing for each system was measured on alkaline paper sheets (copier grade paper having a basis weight of 75 grams/square meter) for 8 weight percent total solids dilute solutions based on dispersion loadings of 4 lbs. dispersion per ton of paper and cationic starch loadings of 40 lbs. per ton of paper. Application of the dispersion was at room temperature using a paper padder. The padder settings were 2.2 meters/minute and 2.5 Bars. The sheets were dipped into a pan containing about 400 milliliters of dispersion one to three times with one padder nip following each dip. The sheets were dried for about two minutes in an Adirondack Drum Dryer set at 105° C. The HST values for the four systems are shown in Table 1.

TABLE 1

| Example | Cation Type | Percent Solids | HST Value, seconds |
|---|---|---|---|
| 3 | Potassium | 20 | 130 |
| 4 | Potassium | 35 | 109 |
| 5 | Ammonium | 20 | 71 |
| 6 | Ammonium | 35 | 42 |

The results in Table 1 indicates that potassium based external sizing agents are more effective than ammonium based sizing agents and that surprisingly preparation of the dispersion at lower solids concentrations can significantly improve sizing efficiency.

EXAMPLES 7–9

In another evaluation, three different dispersions were prepared at 35 percent solids concentrations using the same experimental interpolymer employed for Example 3–6 above. The three dispersions were prepared using shear intensities during digestion and agitation and as such resulted in different initial viscosities for the final dispersions as shown in Table 2 below. The three dispersions were all prepared using potassium as the cation at a 0.42 mole ratio. After the dispersion were prepared, each was admixed with cationic starch and diluted to an 8 percent total solids dilute solution (i.e., 7.08% cationic starch/0.92% interpolymer). The degree of sizing for each dilute solution was measured using Dalum paper (100% recycled grade paper having a basis weight of 93 grams/square meter) at loadings of 10 lbs. dilute solution per ton of paper. Application of the sizing solutions was the same as described for Examples 3–6. Table 2 shows the HST values for each system.

TABLE 2

| Example | Dispersion Viscosity, cP | Dilute Solution Viscosity, cP | HST Value, seconds |
|---|---|---|---|
| 7 | 700 | 145 | 42 |
| 8 | 440 | 198 | 78 |
| 9 | 260 | 234 | 131 |

Table 2 indicates, surprisingly, that dispersions with higher viscosities provide dilute solutions with lower viscosities and lower viscosity dilute solutions provide higher HST values.

EXAMPLES 10 and 11

In another evaluation, two different dispersions were prepared at 20 percent interpolymer solids concentrations using an ethylene acrylic acid copolymer containing 15 weight percent acrylic acid and having a 1300 g/10 minute melt index measured in accordance with ASTM D-1238 Condition 190° C./2.16 kg. Both dispersions were mixed base dispersions. Example 10 was a 0.5 mole ratio potassium/0.7 mole ratio ammonium dispersion and Example 11 was a 0.5 mole ratio sodium/0.7 mole ratio ammonium dispersion. The degree of sizing for the two systems was measured on alkaline paper sheets for dispersion loadings of 4 lbs. dispersion per ton of paper. Application of the dispersions was the same as described for Examples 3–6. The HST values for the two systems are shown in Table 3.

TABLE 3

| Example | Cation Type | HST Value, seconds |
|---|---|---|
| 10 | Potassium/Ammonium | 110 |
| 11 | Sodium/Ammonium | 102 |

The results in Table 3 indicates that mixed based dispersions provide very effective external sizing systems.

What is claimed is:

1. A method of externally sizing a fibrous material comprising:

a) providing a basic aqueous dispersion consisting essentially of an interpolymer of an ethylenically unsaturated monomer and an ethylenically unsaturated carboxylic acid, the dispersion having an initial 23° C. Brookfield viscosity of less than or equal to 500 centipoise as measured with a # 3 spindle at 20 rpms, and b) before application to the material, admixing the dispersion with at least one starch solution to provide a dispersion/starch dilute solution having:

i) a 23° C. Brookfield viscosity of equal to or greater than 150 centipoise as measured with a #3 spindle at 20 rpms, and ii) a total dispersion/starch solids concentration of less than 20 weight percent wherein the sized fibrous material is characterized as having a Hercules Size Test (HST) value at 85 percent reflectance of greater than 100, as determined in accordance with TAPPI Method T 530 pm-89.

2. The method of claim 1 wherein the fibrous material is a cellulosic material.

3. The method of claim 2 wherein the cellulosic material is paper.

4. The method of claim 3 wherein the interpolymer is applied to the paper with a size press.

5. The method of claim 3 wherein the paper contains a filler.

6. The method of claim 1 wherein the fibrous material is a textile material.

7. The method of claim 6 wherein the textile material is a fabric.

8. The method of claim 1 wherein the interpolymer is a copolymer of ethylene and acrylic acid.

9. The method of claim 8 wherein the acrylic acid content is from about 10 to about 25 weight percent of the copolymer.

10. The method of any one of the preceding claims wherein the basic aqueous dispersion is made from aqueous ammonia, alkali metal hydroxide, or alkaline earth metal hydroxide.

11. The method of claim 10 wherein the dispersion is mixed base dispersion.

12. The method of claim 11 wherein the mixed base dispersion employs ammonium and potassium as cations.

13. The method of claim 10 wherein the dispersion is a potassium dispersion.

14. The method of claim 10 wherein the dispersion is a sodium dispersion.

15. The method of claim 1 wherein the fibrous material is internally sized before applying the dispersion.

16. The method of claim 1 wherein the dispersion has an interpolymer solids concentration less than 35 weight percent.

17. The method of claim 1 wherein the starch is a cationic ethylated starch.

* * * * *